US011753822B2

(12) United States Patent
Holdridge

(10) Patent No.: US 11,753,822 B2
(45) Date of Patent: Sep. 12, 2023

(54) CEILING SYSTEM

(71) Applicant: ARMSTRONG WORLD INDUSTRIES, INC., Lancaster, PA (US)

(72) Inventor: Daniel M. Holdridge, Ephrata, PA (US)

(73) Assignee: AWI Licensing LLC, Wilmington, DE (US)

( * ) Notice: Subject to any disclaimer, the term of this patent is extended or adjusted under 35 U.S.C. 154(b) by 0 days.

(21) Appl. No.: 17/750,357

(22) Filed: May 22, 2022

(65) Prior Publication Data

US 2022/0282483 A1 Sep. 8, 2022

Related U.S. Application Data

(63) Continuation of application No. 17/124,097, filed on Dec. 16, 2020, now Pat. No. 11,339,571, which is a (Continued)

(51) Int. Cl.
*E04B 9/26* (2006.01)
*E04B 9/10* (2006.01)
(Continued)

(52) U.S. Cl.
CPC ..... *E04B 9/26* (2013.01); *E04B 9/0478* (2013.01); *E04B 9/06* (2013.01); *E04B 9/068* (2013.01); *E04B 9/10* (2013.01)

(58) Field of Classification Search
CPC . E04B 9/26; E04B 9/0478; E04B 9/06; E04B 9/068; E04B 9/10
See application file for complete search history.

(56) References Cited

U.S. PATENT DOCUMENTS 4,438,613 A 3/1984 Hintsa
4,580,387 A 4/1986 Rogers
(Continued)

FOREIGN PATENT DOCUMENTS

DE 20015765 1/2002
EP 2573290 3/2013
(Continued)

OTHER PUBLICATIONS

Architectural Components Group, Inc., "Flat Panel System," V. 2.0. Series 7. Brochure. Website at: info@acgiwood.com. (2012) US.
(Continued)

*Primary Examiner* — Patrick J Maestri
(74) *Attorney, Agent, or Firm* — Patrick Sheldrake

(57) ABSTRACT

Described herein is a spring clip for mounting ceiling panels equipped with torsion springs to a ceiling support grid. The spring clip includes a body including a mounting portion defining a downwardly open receptacle configured for receiving a portion of a ceiling grid support member of the ceiling support grid, the downwardly open receptacle extending along a receptacle axis from a first side open end to a second side open end; and a pair of lateral flanges extending transversely outwards from the mounting portion and terminating in lateral edges, at least one of the flanges includes a slot extending parallel to the receptacle axis and configured to receive arms of a torsion spring, and a lateral opening extending from the lateral edge to the slot to allow lateral insertion of the arms of the torsion spring into the slot.

20 Claims, 13 Drawing Sheets

Related U.S. Application Data continuation of application No. 16/853,630, filed on Apr. 20, 2020, now Pat. No. 10,914,069, which is a continuation of application No. 16/421,139, filed on May 23, 2019, now Pat. No. 10,626,605, which is a continuation of application No. 14/945,515, filed on Nov. 19, 2015, now Pat. No. 10,309,104, which is a continuation of application No. 14/264,868, filed on Apr. 29, 2014, now Pat. No. 9,194,123.

(51) Int. Cl.
*E04B 9/06* (2006.01)
*E04B 9/04* (2006.01)

(56) References Cited

U.S. PATENT DOCUMENTS

| | | | | |
|---|---|---|---|---|
| 4,679,375 | A | 7/1987 | Shirley | |
| 4,873,809 | A | 10/1989 | Paul | |
| 5,428,930 | A * | 7/1995 | Bagley | E04B 9/003 52/489.1 |
| 6,971,210 | B2 | 12/2005 | Kliegle | |
| 7,076,928 | B2 * | 7/2006 | Kliegle | E04B 9/28 52/506.07 |
| 8,683,768 | B2 | 4/2014 | Gerkes | |
| 9,181,696 | B1 | 11/2015 | Bergman | |
| 9,187,897 | B1 | 11/2015 | Bergman | |
| 9,228,347 | B2 | 1/2016 | Underkofler | |
| 9,453,339 | B2 | 9/2016 | Baxter | |
| 2007/0193131 | A1 | 8/2007 | Ortiz | |

FOREIGN PATENT DOCUMENTS

| | | |
|---|---|---|
| GB | 1030796 | 5/1966 |
| GB | 1104685 | 2/1968 |
| GB | 2147029 | 5/1985 |

OTHER PUBLICATIONS

"Rulon Scored Acoustical Ceiling System. Aluratone 500. Architectural Specifications." and Rulon Scored Acoustical Wall System. Aluratone 500. Architectural Specifications. Rulon International. website at: rulonco.com. (2012) U.S.

* cited by examiner

CEILING SYSTEM

CROSS-REFERENCE TO RELATED APPLICATIONS

This application is a continuation of U.S. patent application Ser. No. 17/124,097, filed on Dec. 16, 2020, which is a continuation of U.S. patent application Ser. No. 16/853,630, filed on Apr. 20, 2020, which is a continuation of U.S. patent application Ser. No. 16/421,139, filed May 23, 2019, which is a continuation of U.S. patent application Ser. No. 14/945,515, filed Nov. 19, 2015, which is a continuation of U.S. patent application Ser. No. 14/264,868, filed on Apr. 29, 2014. The disclosure of the above application is incorporated herein by reference.

FIELD OF THE INVENTION

The present invention relates to suspended ceiling systems, and more particularly to a ceiling system with detachable ceiling panels.

BACKGROUND OF THE INVENTION

Numerous types of suspended ceiling systems and methods for mounting ceiling panels have been used. One type of system includes a suspended support grid including an array of intersecting grid support members configured to hang a plurality of individual ceiling panels therefrom. An improved ceiling system is desired which can facilitate mounting individual panels to the grid and reduces installation costs.

SUMMARY OF THE INVENTION

The present invention provides a spring clip for mounting ceiling panels equipped with torsion springs to a ceiling support grid, the spring clip comprising: a body including a mounting portion defining a downwardly open receptacle configured for receiving a portion of a ceiling grid support member of the ceiling support grid, the downwardly open receptacle extending along a receptacle axis from a first side open end to a second side open end; a pair of lateral flanges extending transversely outwards from the mounting portion and terminating in lateral edges; and wherein at least one of the flanges includes: a slot extending parallel to the receptacle axis and configured to receive arms of a torsion spring; and a lateral opening extending from the lateral edge to the slot to allow lateral insertion of the arms of the torsion spring into the slot.

Other embodiments of the present invention include a spring clip for mounting ceiling panels equipped with torsion springs to a ceiling support grid, the spring clip comprising: a body including a mounting portion defining a downwardly open receptacle configured for receiving a portion of a ceiling grid support member; a pair of lateral flanges extending transversely outwards from the mounting portion and terminating in lateral edges, wherein at least one of the flanges includes: a slot positioned parallel to the body and configured to receive arms of a torsion spring; and a lateral opening extending from the lateral edge of the flange to the slot to allow lateral insertion of the arms of the torsion spring into the slot.

Other embodiments of the present invention include a ceiling system comprising: a longitudinally extending grid support member defining a longitudinal axis, the grid support member including a bottom flange, a top stiffening channel, and a vertical web connecting the stiffening channel to the bottom flange; a ceiling panel; a torsion spring mounted on the ceiling panel; and a spring clip slideably mounted on the grid support member and movable in opposing axial directions, the spring clip comprising: a body including a mounting portion defining a downwardly open receptacle configured for receiving a portion of the grid support member, the downwardly open receptacle extending along the longitudinal axis from a first side open end to a second side open end; and a pair of lateral flanges extending transversely outwards from the mounting portion and terminating in lateral edges; wherein at least one of the flanges includes: a slot extending parallel to the longitudinal axis and configured to receive arms of a torsion spring; and a lateral opening extending from the lateral edge to the slot to allow lateral insertion of the arms of the torsion spring into the slot; and wherein the ceiling panel is supported from the grid support member by the torsion springs.

BRIEF DESCRIPTION OF THE DRAWINGS

The features of the exemplary embodiments of the present invention will be described with reference to the following drawings, where like elements are labeled similarly, and in which.

Figure 1:
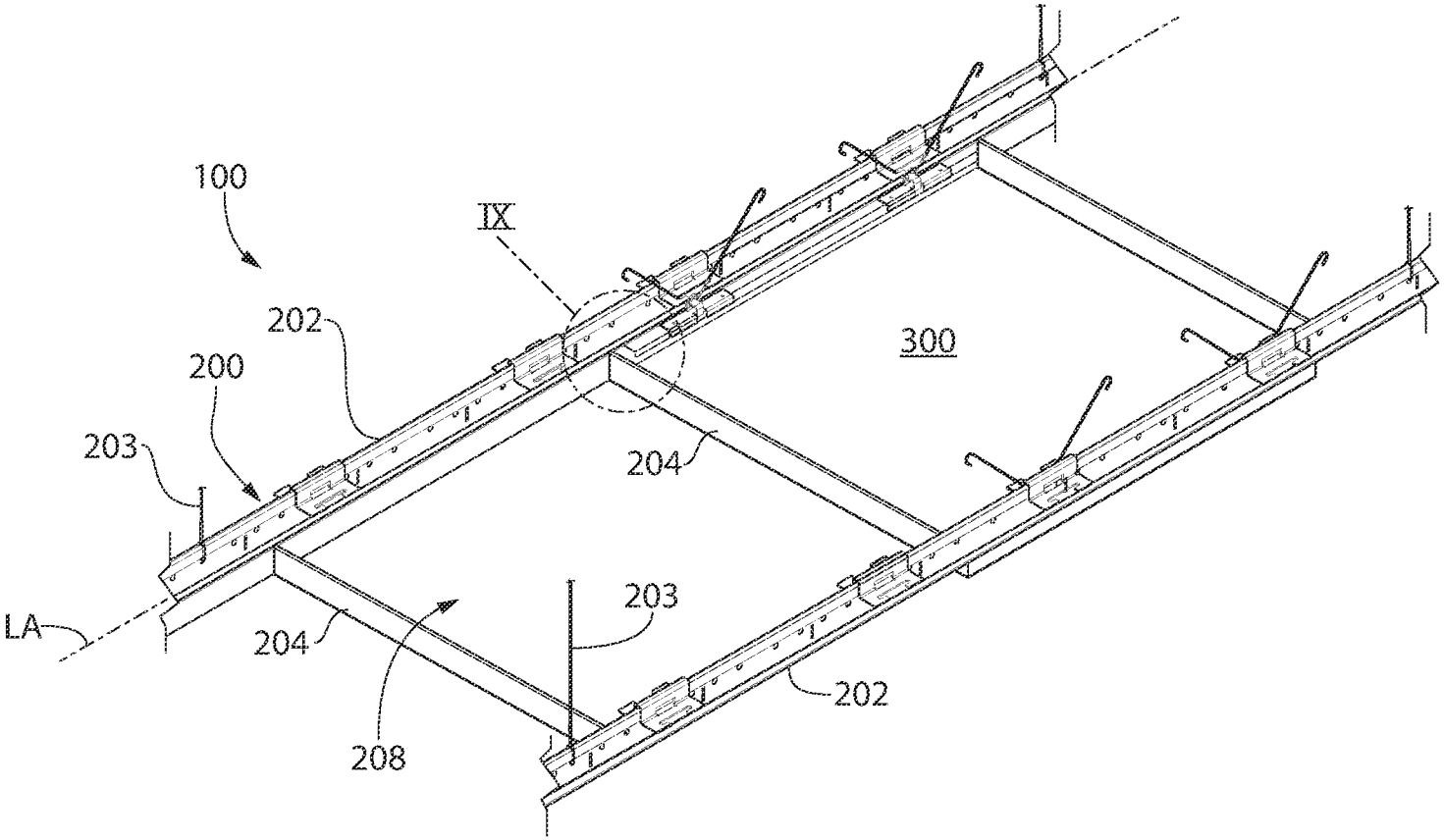
FIG. 1 is a top perspective view a ceiling system including an overhead suspended support grid and ceiling panels according to the present disclosure.

All drawings are schematic and not necessarily to scale. Parts given a reference numerical designation in one figure may be considered to be the same parts where they appear in other figures without a numerical designation for brevity unless specifically labeled with a different part number and described herein.

DETAILED DESCRIPTION OF THE EMBODIMENTS

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Figure 2:
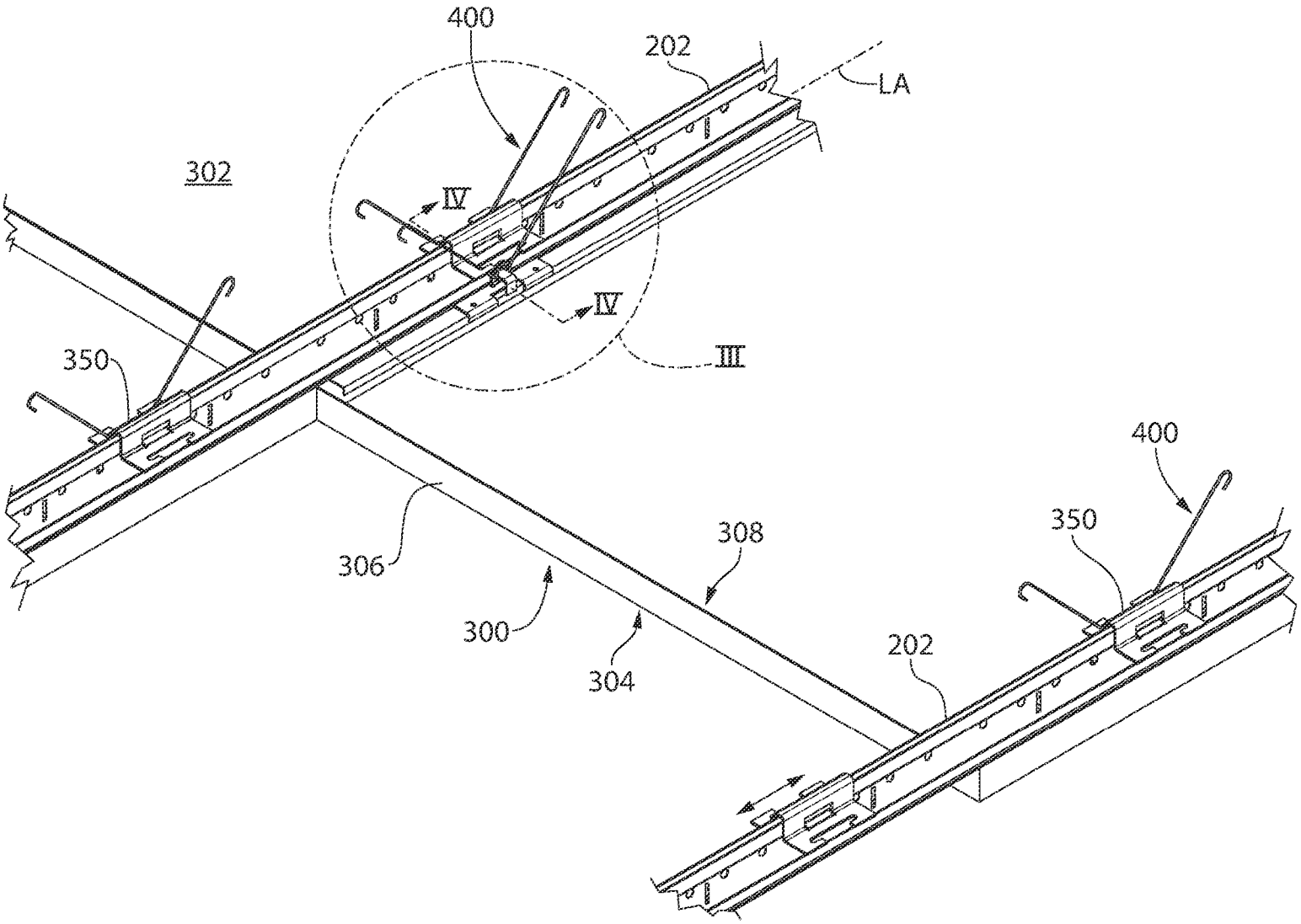
FIG. 2 is an enlarged view thereof.
Figure 3:
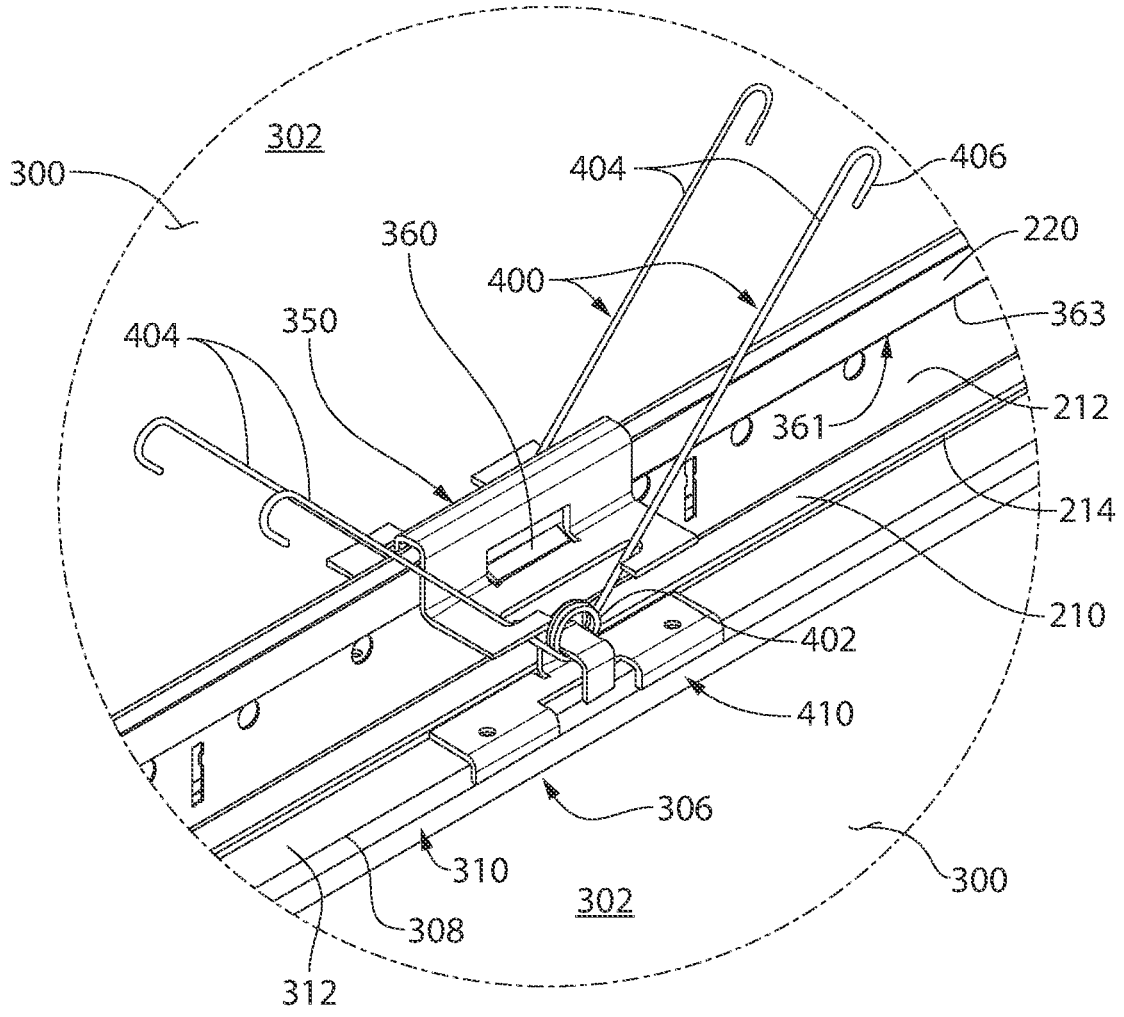
FIG. 3 is an enlarged view from FIG. 2 showing a detail for coupling a torsion spring and ceiling panel to a grid support member of the support grid from FIG. 1.

FIGS. 1-3 depict an exemplary embodiment of a ceiling system 100 according to the present disclosure. The ceiling system 100 includes an overhead support grid 200 mountable in a suspended manner from an overhead building support structure. Support grid 200 includes a plurality intersecting longitudinal grid support members 202 and lateral grid support members 204. Longitudinal and lateral grid support members 202, 204 are elongated in shape having a length greater than their respective width (e.g. at least twice), and in various embodiments lengths substantially greater than their widths (e.g. 3 times or more). Longitudinal grid support member 202 may have a substantially greater length than lateral grid support member 204 and form "runners" or "rails" which are maintained in a substantially parallel spaced apart relationship by the lateral grid support members. The lateral grid support members 204 may be attached between adjacent (but spaced apart) longitudinal grid support members 202 at appropriate intervals using any suitable permanent or detachable manner employed in the art. The combination of interconnected longitudinal and lateral grid support members 202, 204 provides lateral stability to the support grid 200.

In one embodiment, grid support members 202 and 204 may be horizontally oriented when installed. It will be appreciated, however, that other suitable mounted orientations of support members 202, 204 such as angled or slanted (i.e. between 0 and 90 degrees to horizontal). Accordingly, although support members 202, 204 may be described in one exemplary orientation herein as horizontal, the invention is not limited to this orientation alone and other orientations may be used.

Longitudinal and lateral grid support members 202, 204 intersect to form an array of grid openings 208 which become essentially closed by ceiling panels 300 positioned below or within the openings. In some embodiments, the grid support members 202, 204 may be arranged in an orthogonal pattern wherein the support members intersect at right angles to form rectilinear grid openings 208 such as squares or rectangles (in top plan view). The terminal ends of the lateral grid support members 204 may be configured to interlock with the transversely oriented longitudinal grid support members 202 at right angles to form the rectilinear grid pattern in any manner used in the art. Any suitable interlocking mechanism and configuration may be used, including for example without limitation interlocking tabs and slots, brackets, clips, etc. Accordingly, the present invention is not limited by the manner of attachment used.

Figure 4A:
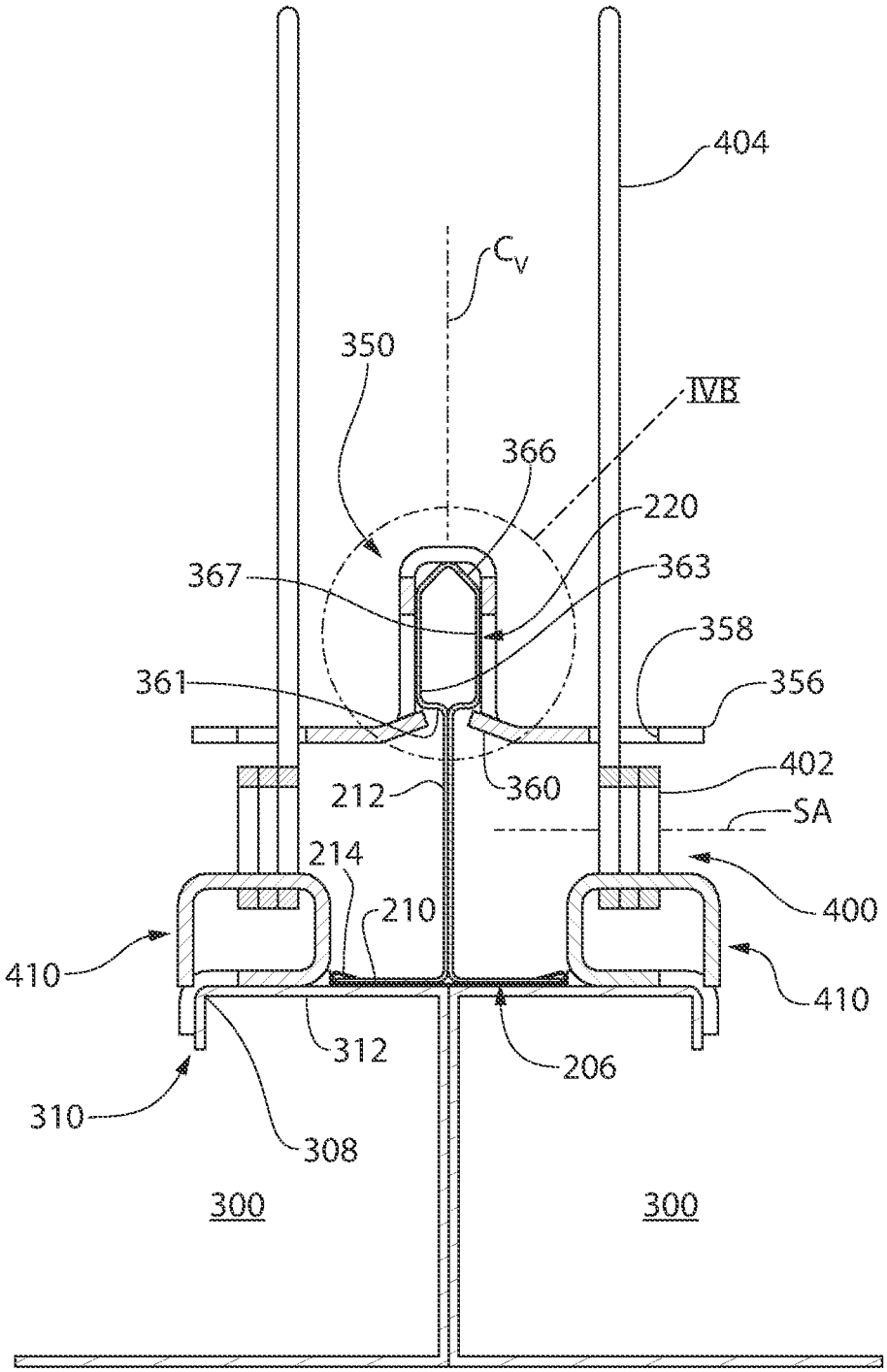
FIG. 4A is transverse side cross sectional view taken along line IV-IV in FIG. 2.
Figure 4B:
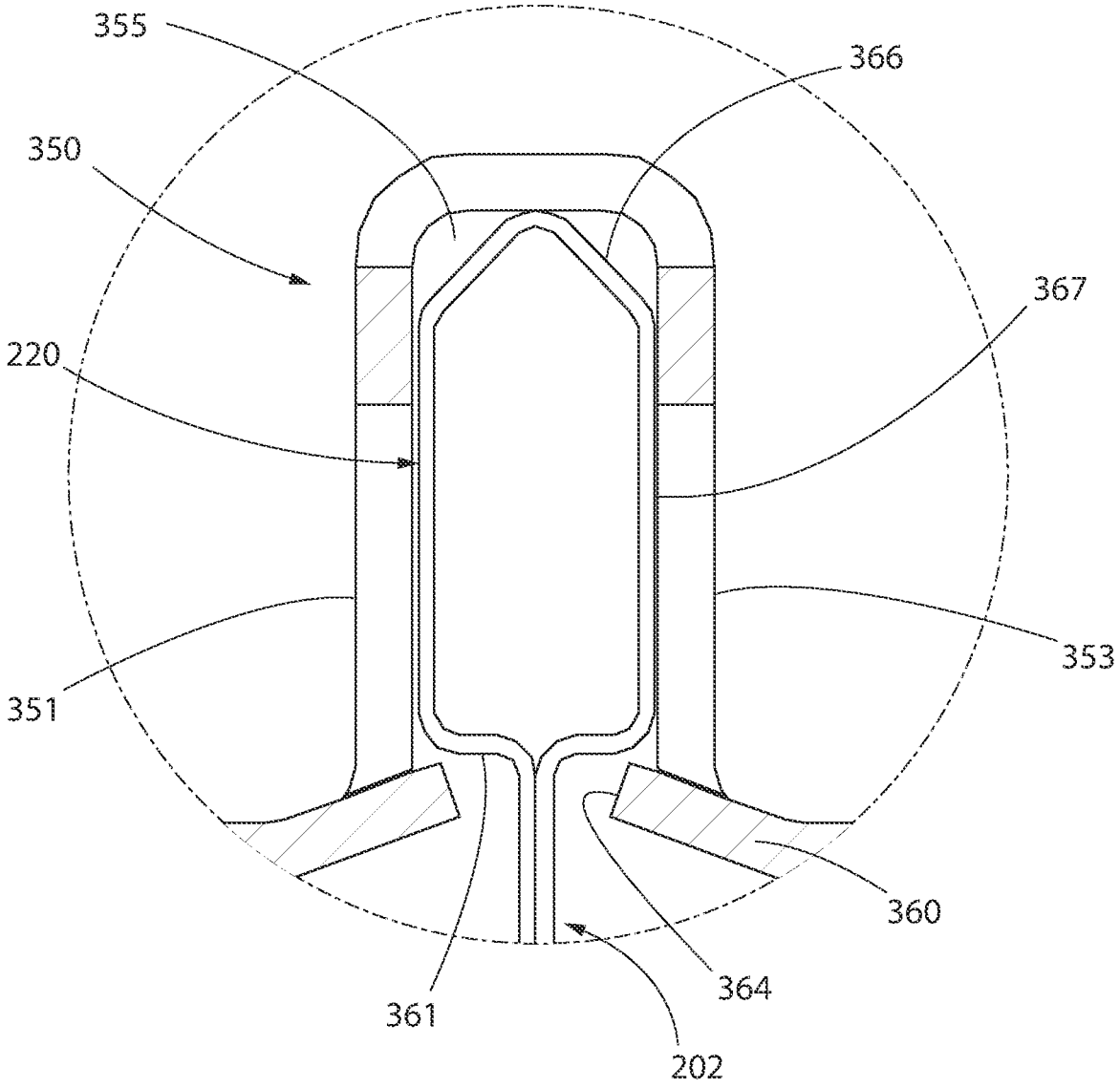
FIG. 4B is an enlarged view from FIG. 4B.
Figure 5:
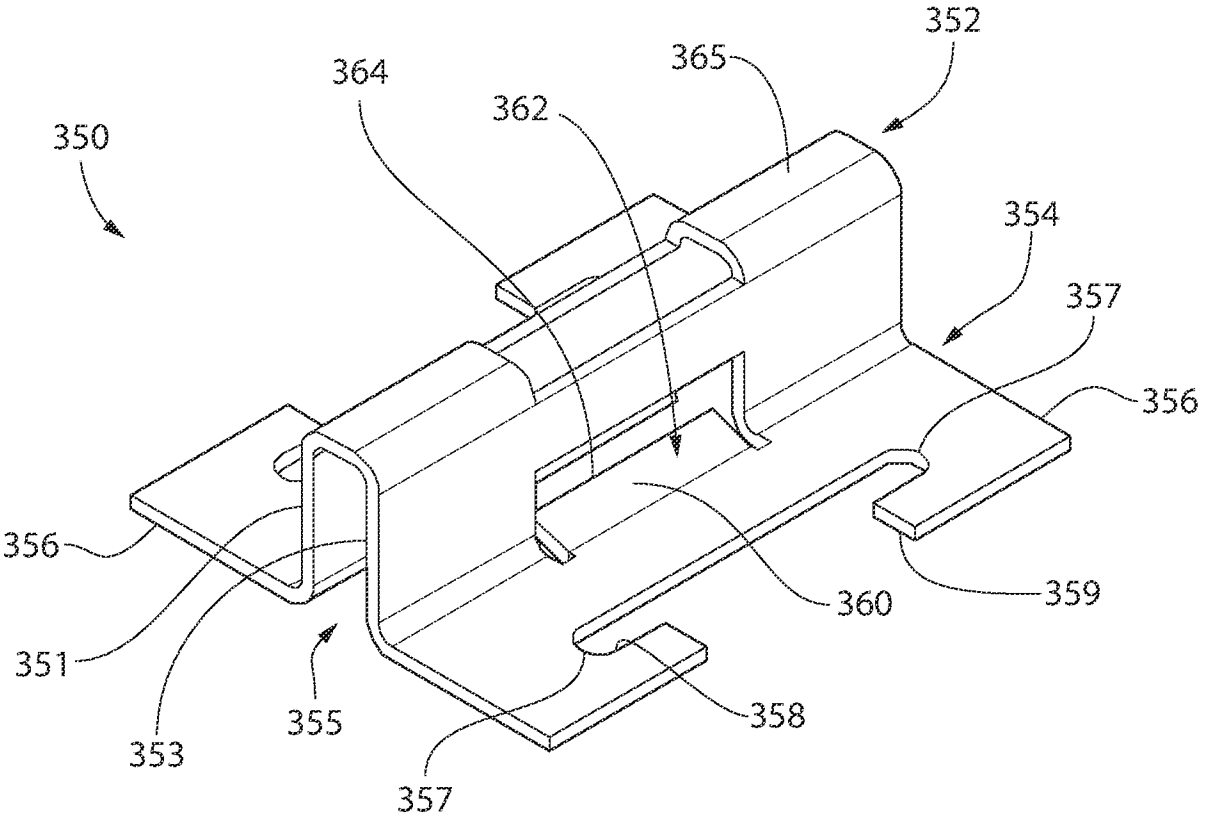
FIG. 5 is a top perspective view of a spring clip from FIG. 1 for coupling the torsion spring to a grid support member.
Figure 6:
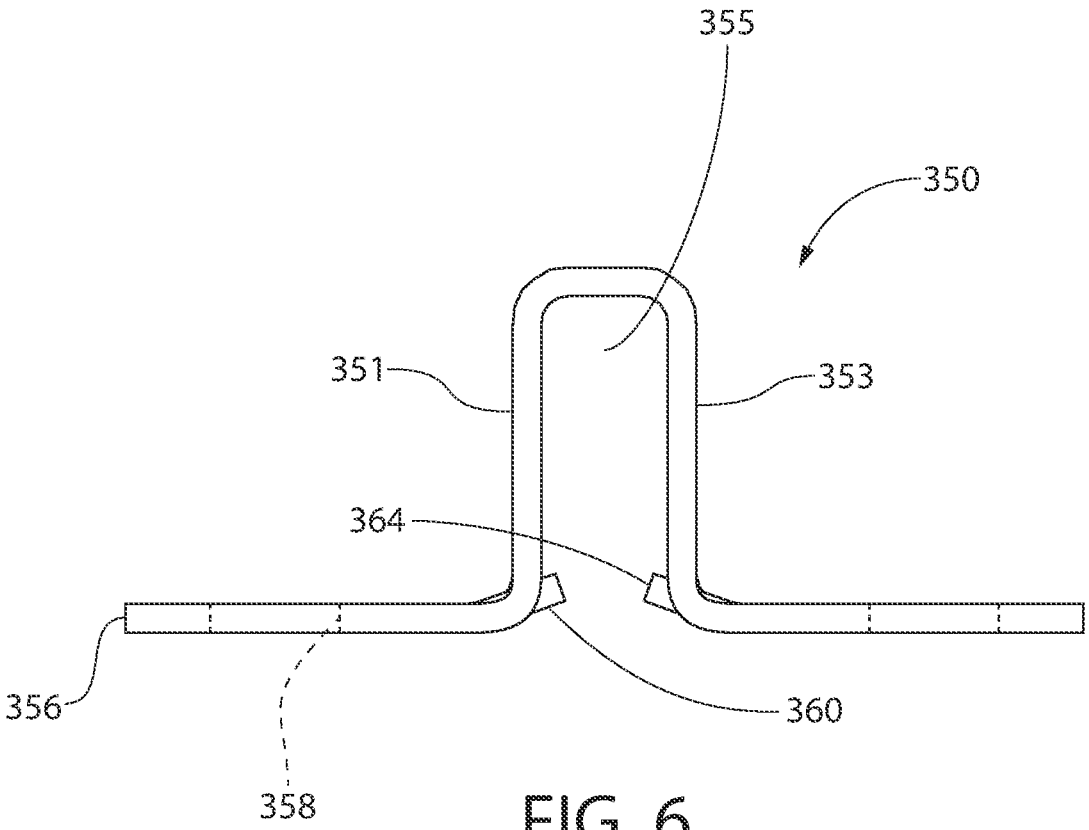
FIG. 6 is a side elevation view thereof.

With additional reference to FIG. 4A-B, longitudinal and lateral grid support members 202, 204 may be T-shaped (e.g. T-rails) in transverse cross section. The grid support members have an inverted T-shaped configuration when in an installed position suspended from an overhead building ceiling support structure. The support members 202, 204 may be suspended from the building ceiling support structure via a hanger mechanism 203, such as for example without limitation fasteners, hangers, wires, cables, rods, struts, etc.

Referring to FIGS. 1-4, grid support members 202, 204 include a longitudinally-extending horizontal bottom flange 210, a bulbous top stiffening channel 220, and a vertical web 212 extending upwards from the flange to the stiffening channel. The longitudinal grid support members 202 each define a respective longitudinal axis LA and axial directions. Web 212 may be centered between opposing longitudinally extending edges 214 of flange 210 in one embodiment. Bottom flange 210 has opposing portions which extend laterally outwards from web 212 and terminate in opposed longitudinally extending edges 214. In one embodiment, edges 214 may have a slightly enlarged bulbous configuration in transverse cross-section. Bottom flange 210 further defines a bottom surface 206 facing downwards away from the flange and towards a room or space below the support grid 200. Bottom surface 206 defines a horizontal reference plane for the overhead support grid 200. When mounted to the ceiling support grid 200, the upward facing top surfaces of the ceiling panel 300 may be positioned proximate to or contact the bottom surfaces 206 of the grid support members 202, 204.

Grid support members 202, 204 may be made of any suitable metallic or non-metallic materials structured to support the dead weight or load of ceiling panels 300 without undue deflection. In some preferred but non-limiting embodiments, the grid support members may be made of metal including aluminum, titanium, steel, or other. In one embodiment, the grid support members 202, 204 may be a standard heavy duty 15/16 inch aluminum T-rail.

Referring to FIGS. 1-8, ceiling panel 300 may have a generally flattened body with a substantially greater horizontal width and length than vertical thickness as shown. Ceiling panel 300 includes a top surface 302, bottom surface 304, and lateral sides 306 extending therebetween along four sides of the panel. Top and bottom surfaces 302, 304 may be generally planar and arranged parallel to each other in one embodiment. In one non-limiting embodiment, the lateral sides 306 may be planar forming opposing pairs of parallel lateral sides.

It will be appreciated that the top and bottom surfaces 302, 304 of ceiling panels 300 may have other configurations or surface profiles rather than planar. In other possible configurations, the front and rear surfaces 302, 304 may have irregular surfaces including various undulating patterns, designs, textures, perforations, ridges/valleys, wavy raised features, or other configurations for aesthetic and/or acoustic (e.g. sound reflection or dampening) purposes. Accordingly, top and bottom surfaces 302, 304 are not limited to any particular surface profile or configuration. The invention is therefore not limited to any of the particular foregoing constructions.

Ceiling panels 300 may be constructed of any suitable material including without limitation mineral fiber board, fiberglass, jute fiber, metals, polymers, wood, or other. In addition, the ceiling panels 300 may have any suitable dimensions and shapes (in top plan view) including without limitation square or rectangular.

Referring to FIGS. 1-8, the ceiling panels 300 may be mounted to the support grid 200 using torsion springs 400 and snap-on slidable slotted spring clips 350 which are movably mounted on support grid 200. The torsion springs 400 each include a coil 402 and two upwardly projecting arms 404 which are disposed at angle in relation to each other forming a characteristic V-shape. Torsion springs 400 are commercially available. Arms 404 may be arranged tangentially to the circular coil 402 which defines a mounting axis SA. The arms 404 may have recurved or hooked ends 406 configured to engage the spring clips 350, as further described herein. Torsion springs 400 may be formed of a suitable spring material, such as without limitation steel wire having an elastic memory.

Ceiling panels 300 include spring-mounting brackets 410 configured to capture the coil 402 of torsions springs 400 for attaching the springs to the panels. Brackets 410 may have any suitable configuration that may be coupled to the ceiling panel 300 along the perimeter edges 308 of the panels (see, e.g. FIGS. 1-4 and 8). In one embodiment, the opposed longitudinally extending lateral sides 306 may include metallic mounting angles 310 for attaching the brackets 410 to the ceiling panel 300 such as via fasteners, adhesives, welding/soldering, or other suitable attachment methods. In one configuration, the angles 310 may each include a longitudinally extending horizontal lip 312, which may project inwards from the lateral sides 306 of the ceiling panel 300. The lip 312 defines a convenient flat horizontal surface for mounting the brackets 410.

Referring to FIGS. 3-6, spring clips 350 have a body configured for mounting on longitudinal grid support members 202. In one embodiment, spring clips 350 include an inverted U-shaped central mounting portion 352 configured to engage the bulbous top stiffening channel 220 of longitudinal grid support member 202 and a lateral spring-mounting portion 354. Mounting portion 352 may be comprised of a horizontal top wall 365 and pair of opposing and laterally spaced apart vertical sidewalls 351 and 353 forming a downwardly open receptacle 355 for receiving stiffening channel 220 of the grid support member 202. Receptacle 355 defines a receptacle axis which is aligned with longitudinal axis LA of grid support members 202. Spring-mounting portion 354 may be comprised of a pair of horizontally projecting lateral flanges 356 configured to engage arms 404 of torsion spring 400. Flanges 356 are arranged on opposing sides of mounting portion 352 and protrude outwards in opposing lateral (horizontal) directions. Spring clip 350 has a shorter axial length as shown than grid support members 202 and/or 204.

Flanges 356 each include a laterally open and elongated slot 358 which receives arms 404 of torsion spring 400 therein. Slots 358 extend in the longitudinal direction parallel to longitudinal axis LA of grid support members 202. A lateral opening 359 in each flange 356 communicates with the slots 358 to facilitate insertion of the spring arms 404 into the slots. Lateral opening 359 has a shorter longitudinal width (measured along the longitudinal axis LA) than the longitudinal length (measured along the longitudinal axis LA) of the slots 358 in one embodiment. The slots 358 define opposing ends 357 configured to engage and retain arms 404 of torsions spring 400, as further described herein.

Advantageously, spring clips 350 are configured to slide in opposing axial directions along the grid support members 202 when mounted thereon. This permits the clip to be located and maintained in a continuum of possible mounting positions along support members 202. Accordingly, an installer need not pre-measure and pre-mount the spring clips 350 in a precise location on grid support members 202 to coincide with the fixed mounting positions of the torsion springs 400 usually already pre-mounted on ceiling panel 300 to prevent the clips from falling off during ceiling installation. Instead, the spring clips 350 may easily be adjusted in axial position to match the fixed torsion spring locations while mounting the ceiling panel 300 to grid support member 202. Pre-measuring and precise layout of the spring clips 350 on the grid support members 202 in advance are therefore obviated. Overall, this makes hanging the ceiling panels 300 more convenient and less time consuming, thereby advantageously reducing installation costs.

Referring to FIGS. 3-6, spring clip 350 further includes at least one opposing pair of resiliently movable locking tabs 360. In one embodiment, locking tabs 360 may be centrally located on spring clip 350 at the midpoint between the axial ends of the clip as shown. Other locations of locking tabs 360 are possible. The locking tabs 360 are configured to engage grid support member 202 for locking the clip 350 in one of the plurality of possible mounting positions on the grid support member. In one embodiment, the locking tabs 360 may each be disposed on the flanges 356. The tabs 360 define an upward facing bearing surface 362, a portion of which may engage the downward facing bottom surface 361 and/or adjacent longitudinally extending bottom edge 363 of the bulbous top stiffening channel 220 on grid support members 202.

Locking tabs 360 project horizontally inwards from each lateral flange 356 into the receptacle 355 and are disposed at an angle A1 to the flanges in one embodiment. This forms longitudinally extending upturned edges 364 on each locking tab 360 that engage the bottom surface 361 and bottom edge 363 on the grid support member bulbous top stiffening channel 220. This locks the spring clip 350 onto grid support member 202 to prevent vertical or transverse detachment of spring clip from the support member. In non-limiting exemplary embodiments, angle A1 may be between 0 and 45 degrees. The angled orientation of the locking tabs further facilitates smooth engagement with the top slanted surfaces 366 of the top stiffening channel 220 of grid support member 202 and initiation of lateral deflection of the tabs when the spring clip 350 is mounted on the support member, as further described herein.

Figure 7A:
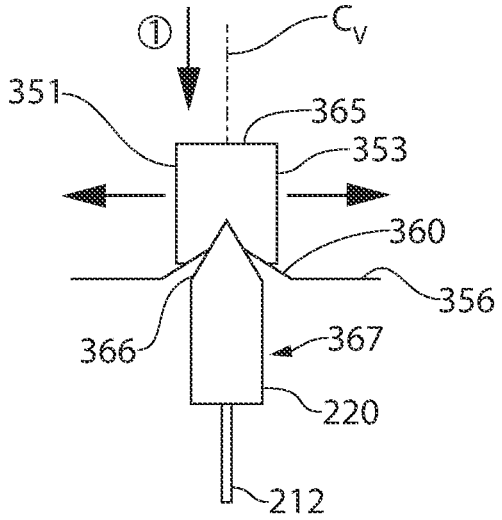
FIGS. 7A-C are schematic views showing sequential steps in mounting the spring clip of FIGS. 5 and 6 to a grid support member.
Figure 7B:
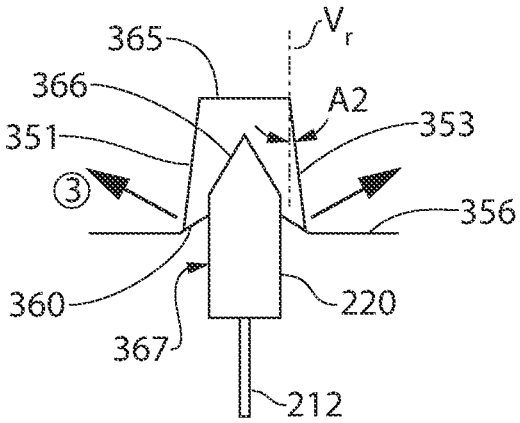
Figure 7C:
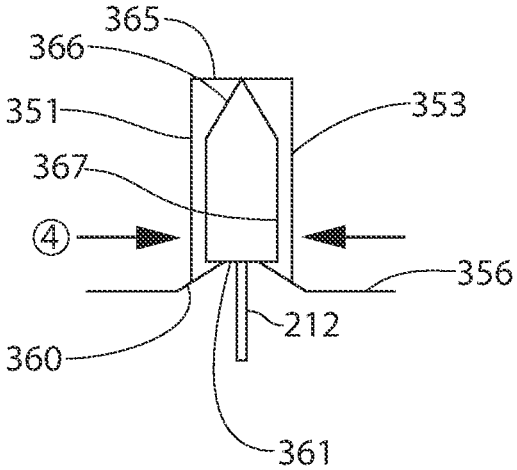

The locking tabs 360 are spaced laterally apart by a distance D1 small enough to engage the opposing sidewalls 367 of the bulbous top stiffening channel 220 and displace or deflect the tabs laterally outwards when the channel is inserted into the spring clip receptacle 355, as best shown in FIGS. 7A-C and further described herein. To accomplish this, the edges 364 of locking tabs 360 project inwards beyond sidewalls 351, 353. Accordingly, the locking tabs 360 are separated from each other by a lateral distance D1 which is smaller than the lateral distance D2 measured between the interior surfaces of sidewalls 351, 353 of spring clip 350. Distance D2 is slightly larger than the exterior lateral width W1 of the top stiffening channel 220 of grid support members 202 for insertion of the stiffening channel therein as shown. Conversely, distance D1 is smaller than Width W1 to enable the lateral deflection of the locking tabs 360.

In one embodiment, the locking tabs 360 may be configured to snap into a position beneath and proximate to the bottom surface 361 of the top stiffening channel 220 on grid support member 202. The locking tabs 360 are each positioned vertically below and trapped beneath the bottom surface 361 such that the spring clip 350 cannot be vertically or transversely withdrawn from the grid support member 202 after installation of the clip. In such an arrangement, the spring clip 350 is freely slidable in opposing axial directions on the grid support member.

In another embodiment, the locking tabs 360 may be configured to frictionally engage the grid support member 202 (i.e. bottom surface 361 of bulbous top stiffening channel 220) creating a slight compressive force between the locking tabs and grid support member. This arrangement assists with retaining the locking tabs 361 in a desired axial mounting position on longitudinal grid support members 202 during the ceiling installation process. The locking tabs 360 are preferably configured, however, to not create a frictional force so great as to preclude the spring clip 350 from moving slideably in axial position along the grid support members 202. The locking tabs 360 therefore create a snug, but slidable fit and attachment between the spring clips 400 and the grid support members 202 capable of maintaining the axial position of the spring clips during installation of the ceiling panels 300.

The entire spring clip 350 may be made of an elastically deformable resilient material to facilitate installing the clip on the grid support members 202. In non-limiting exemplary embodiments, the spring clip may be made of metal such as without limitation galvanized steel, cold rolled steel, spring steel, stainless steel, aluminum, etc. or non-metal such as a suitable polymer with sufficient strength and flexibility. The U-shaped geometry of the spring clip 350 when constructed of such a resilient material allows the opposing flanges 356 of the clip to spread apart horizontally and laterally outwards when the bulbous top stiffening channel 220 is inserted vertically upwards into the receptacle 355 of the grid support member 202. Angled or slanted opposing top surfaces 366 on the top of the top stiffening channel 220 engage the locking tabs 360 to spread the sidewalls 351, 353 and flanges 356 apart, as further described in mounting method disclosed herein.

In one embodiment, the spring clip 350 may have a unitary structure being formed of a single piece of material which may be bent, molded, or otherwise formed to produce the foregoing features of the clip. Accordingly, the flanges 356, locking tabs 360, sidewalls 351, 353, and top wall 365 may be integrally formed as part of the unitary spring clip structure. In other possible embodiments, one or more of these features may be formed as separate elements and assembled in the spring clip 350 by any suitable method used in the art (e.g. welding, soldering, fasteners, etc.). The invention is therefore not limited in the type of construction used to form spring clip 350.

In other embodiments contemplated, the locking tabs 360 need not be arranged in laterally opposing in relationship to each other. Accordingly each locking tab 360 may be axially offset or staggered in position from the other locking tab on flanges 356 in some embodiments. In addition, more than two locking tabs 360 may be provided including even and odd numbers of locking tabs. For example, in one possible alternative embodiment, a single centrally located locking tab 360 may be provided on one flange 356 and two axially spaced apart locking tabs may be provided on the other flange on opposite sides of the single tab. Numerous arrangements of locking tabs 360 are therefore possible. Locking tabs 360 have an axial length less than the axial length of the spring clip 350 in one embodiment, as shown (see, e.g. FIG. 5). The axial length of each locking tab 360 may also be varied or different.

An exemplary method for installing spring clips 350 on longitudinal grid support members 202 will now be described. Reference is made to FIGS. 4A-B and FIGS. 7A-C schematically showing sequential steps in the spring clip mounting process. The numbered directional arrows in FIGS. 7A-C show the relative movement and deformation of the spring clip 350 during the mounting process.

A spring clip 350 is provided and positioned above the top of grid support member 202. The receptacle 355 of the spring clip 350 is vertically aligned with the bulbous top stiffening channel 220 of grid support member 202 along the vertical centerline Cv defined by the support member. The spring clip 350 is then lowered into engagement with (if not already) the grid support member wherein top stiffening channel 220 partially enters a lower portion of the receptacle 355, as shown in FIG. 7A. The opposed upturned edges 364 of the mounting clip locking tabs 360 initially make abutting contact with the two opposed slanted top surfaces 366 on the stiffening channel 220. It should be noted that the sidewalls 351, 353 and locking tabs 360 of the spring clip 350 are still in their initial undeflected position and oriented substantially parallel to each other (FIG. 7A).

The clip 350 is then pressed downward against the stiffening channel 220 of grid support member 202 with sufficient force to cause the locking tabs 360 and flanges 356 of spring clip 350 to be progressively deflected and displaced laterally outwards in opposing directions (see arrows) as the edges 364 of locking tabs slide farther downward and outward respectively along the slanted top surfaces 366 of the stiffening channel. The locking tabs are deflected and displaced from an inward position to an outward position. Distance D1 between the locking tabs 360 concomitantly increases from the undeflected position of the tabs shown in FIG. 6.

Eventually, in the continued downward movement of spring clip 350, the locking tabs 360 will leave the top slanted surfaces 366 and slideably engage the vertical sidewalls 367 of bulbous top stiffening channel 220, thereby reaching a maximum lateral deflection position (i.e. outward position) as shown in FIG. 7B. The sidewalls 351, 353, of spring clip 350 are also in a maximum non-parallel orientation in relation to each other being disposed at an angle A2 with respect to a vertical reference line Vr coinciding with the original undeflected position of the sidewalls. Angle A2 is greater than 0 degrees and less than 45 degrees in one embodiment, and in some instances may be very small between 0 and 15 degrees. The resilient construction of the spring clip 350 allows the sidewalls 351, 353 to deform in relation to the top wall 365.

The locking tabs 360 continue to slide downward while maintaining contact with sidewalls 367 until they eventually reach a vertical position below the sidewalls 367 of the bulbous top stiffening channel 220 on the grid support member 202. The elastic memory of the spring clip 350 now causes the sidewalls 351, 353 and locking tabs 360 to snap back and move inwards to their original undeflected inward position as shown in FIG. 7C. The upturned edges 364 on each locking tab 360 and adjacent portion of bearing surfaces 362 may engage the bottom surface 361 on the top stiffening channel 220 forming a frictional snap-fit that prevents vertical or transverse withdrawal of the spring clip 350 from the grid support member 202. In some embodiments, the locking tabs 360 may vertically fall and be spaced slightly below the bottom surface 361 of stiffening channel 220 rather than in direct frictional contact, but nonetheless are still snap-fit into position onto grid support member 202 and similarly cannot be withdrawn. This latter arrangement allows the spring clips 350 to freely slide in axial position along grid support member 202 with minimal resistance. In either of the foregoing arrangements, the locking tabs are trapped below the stiffening channel to prevent withdrawal of the spring clip 350 from the grid support member 202.

The top stiffening channel 220 of the grid support member 202 is fully inserted into the upper and lower portions of the spring clip receptacle 355. The spring clip 350 is now fully mounted on grid support member 202 (see, e.g. FIGS. 4A-B). Advantageously, the locking tabs 360 allow mounting the spring clip 350 to grid support member 202 without the use of fasteners and cannot fall off the support member when a ceiling panel 300 and torsion spring 400 are mounted thereto. Accordingly, the spring clip 350 may now be slid axially in the fully mounted position to the desired axial position on the grid support member 202 (see bi-directional arrow in FIG. 2) for mounting the ceiling panel 300 using the torsion springs 400.

It will be appreciated that numerous variations in the foregoing ceiling panel installation process and sequence are possible. In addition, it is possible to vertically or transversely detach or withdraw the spring clips 350 from grid support member 202 by forcing or prying the flanges 356 and locking tabs 360 laterally apart with a tool, and then sliding the spring clip upwards back off the support member. This will disengage the locking tabs 360 from underneath the bottom surface 361 of the top stiffening channel 220 to unlock the spring clips 350.

In some embodiments, it will be appreciated that spring clips 400 may also be mounted on the lateral grid support members 204 in the same manner described above either in addition to or instead of the longitudinal grid support members 202 to support the ceiling panels 300.

Figure 8A:
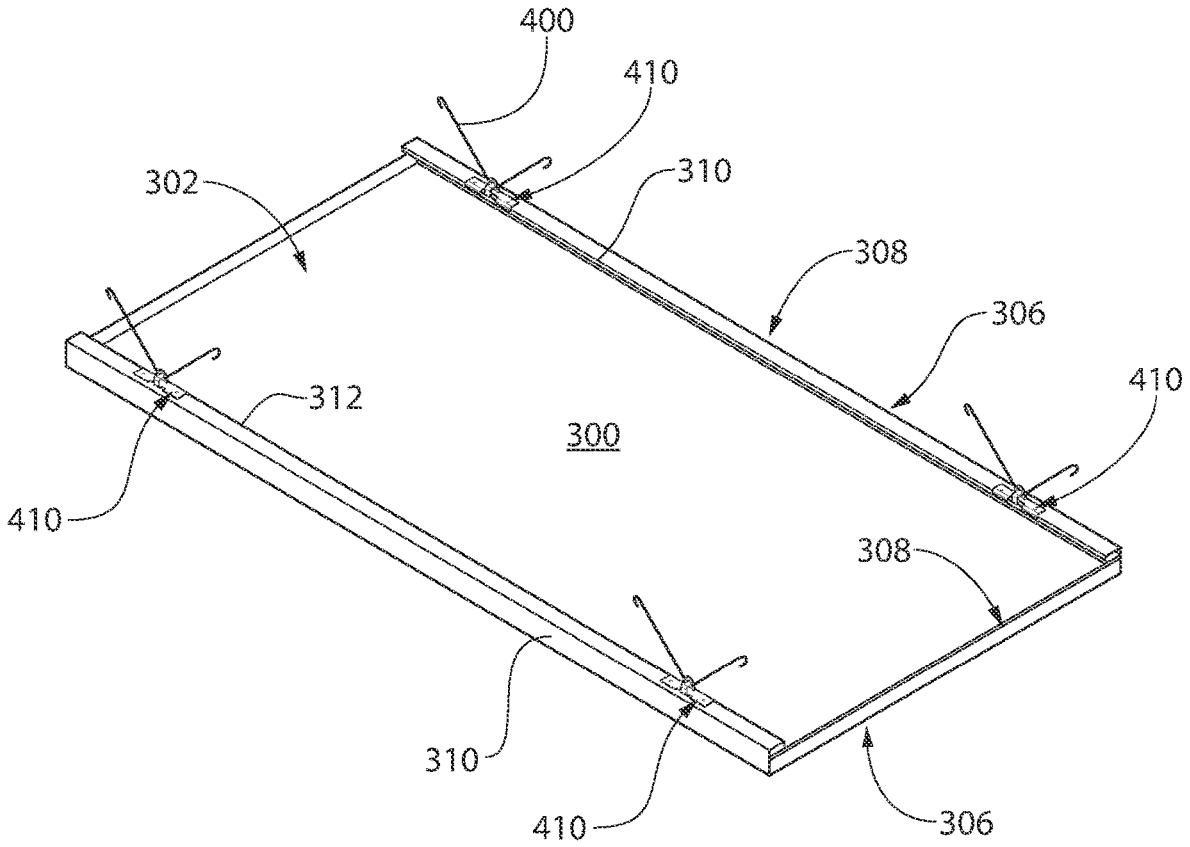
FIG. 8A is a top perspective view of a ceiling panel with torsion springs mounted thereto.
Figure 8B:
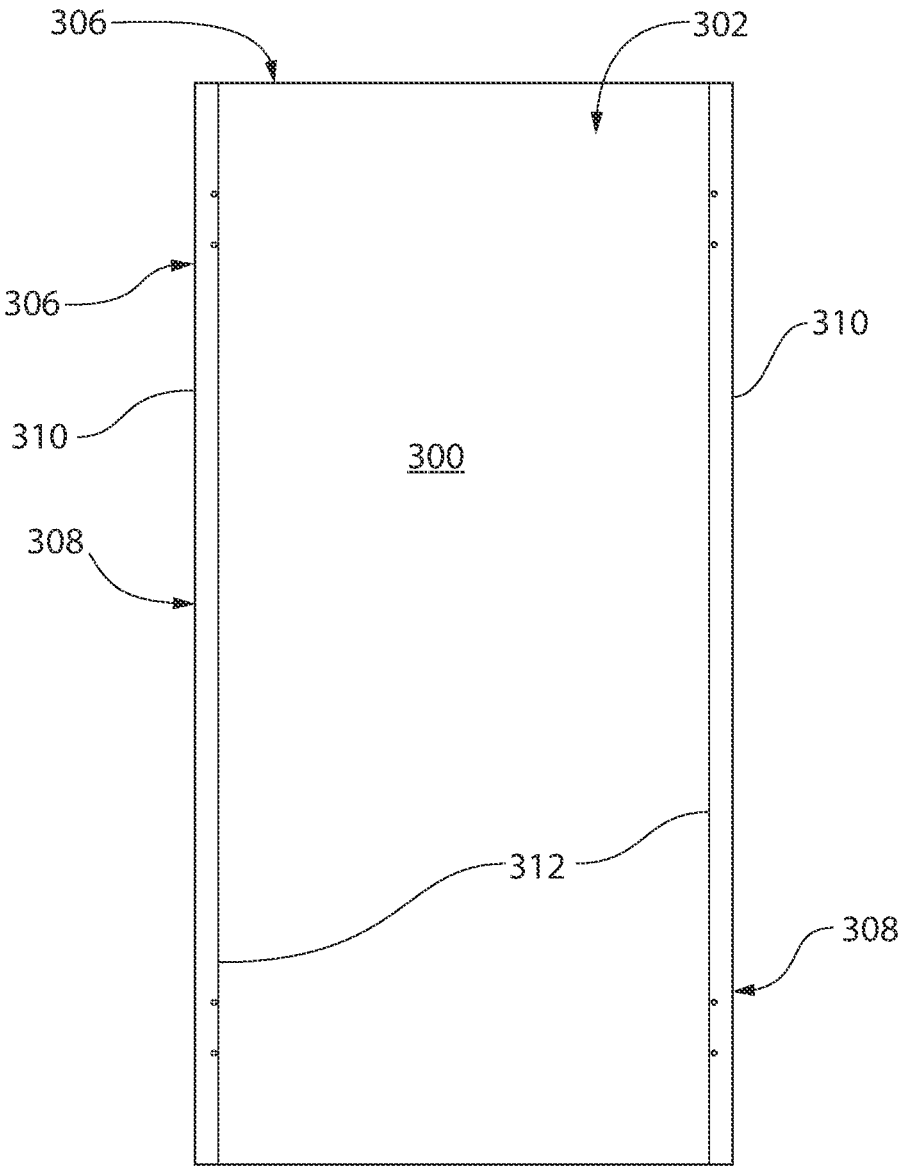
FIG. 8B is a top plan view thereof.
Figure 8C:
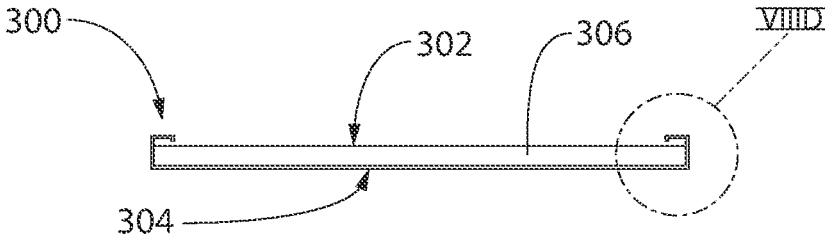
FIG. 8C is an end elevation view thereof.
Figure 8D:
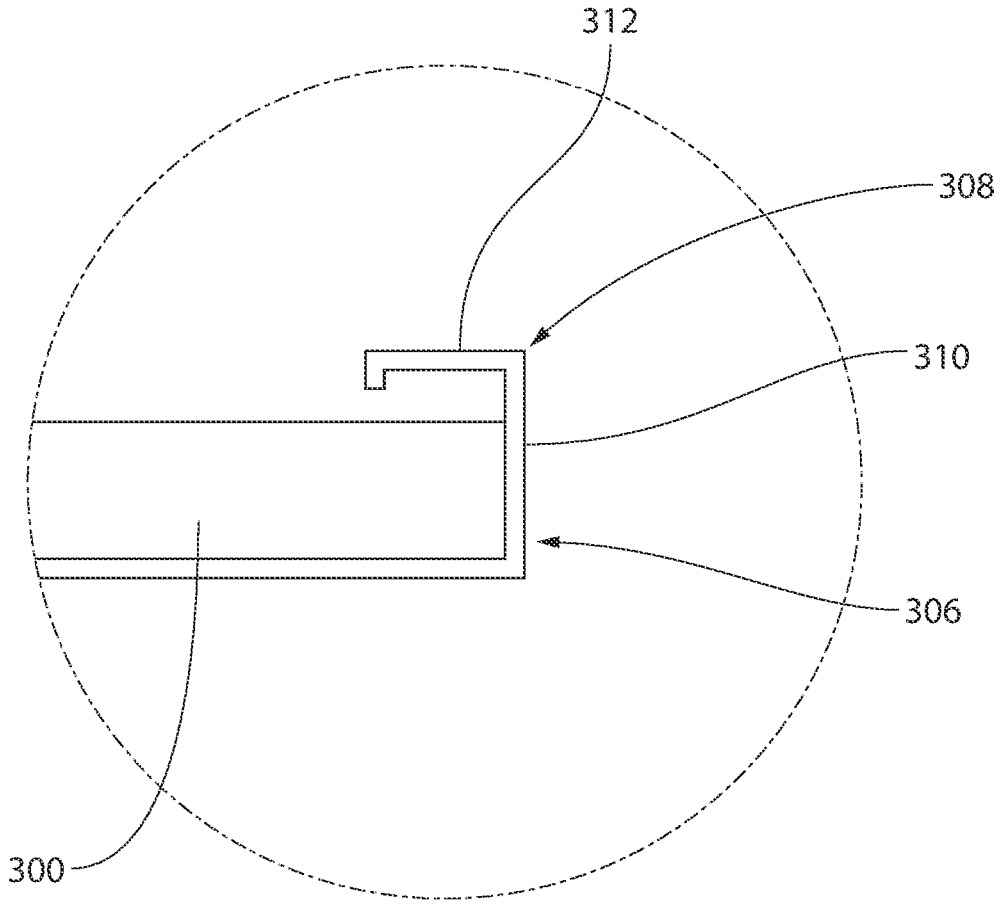
FIG. 8D is an enlarged detail from FIG. 8C.

Multiple spring clips 350 may be provided to satisfactorily support a single ceiling panel 300 from the overhead support grid 200. In one non-limiting embodiment, four spring clips 350 may be provided as shown in FIGS. 1 and 8A. Larger ceiling panels may require additional spring clips for proper support.

After the spring clips 350 have been installed on the support grid 200, the ceiling panels 300 with pre-installed torsion springs 400 (see, e.g. FIG. 8A) may be hung. If the spring clips 350 do not align vertically with the torsions springs 400, the spring clips may be slid along the grid support member 200 to adjust the alignment.

Figure 9:
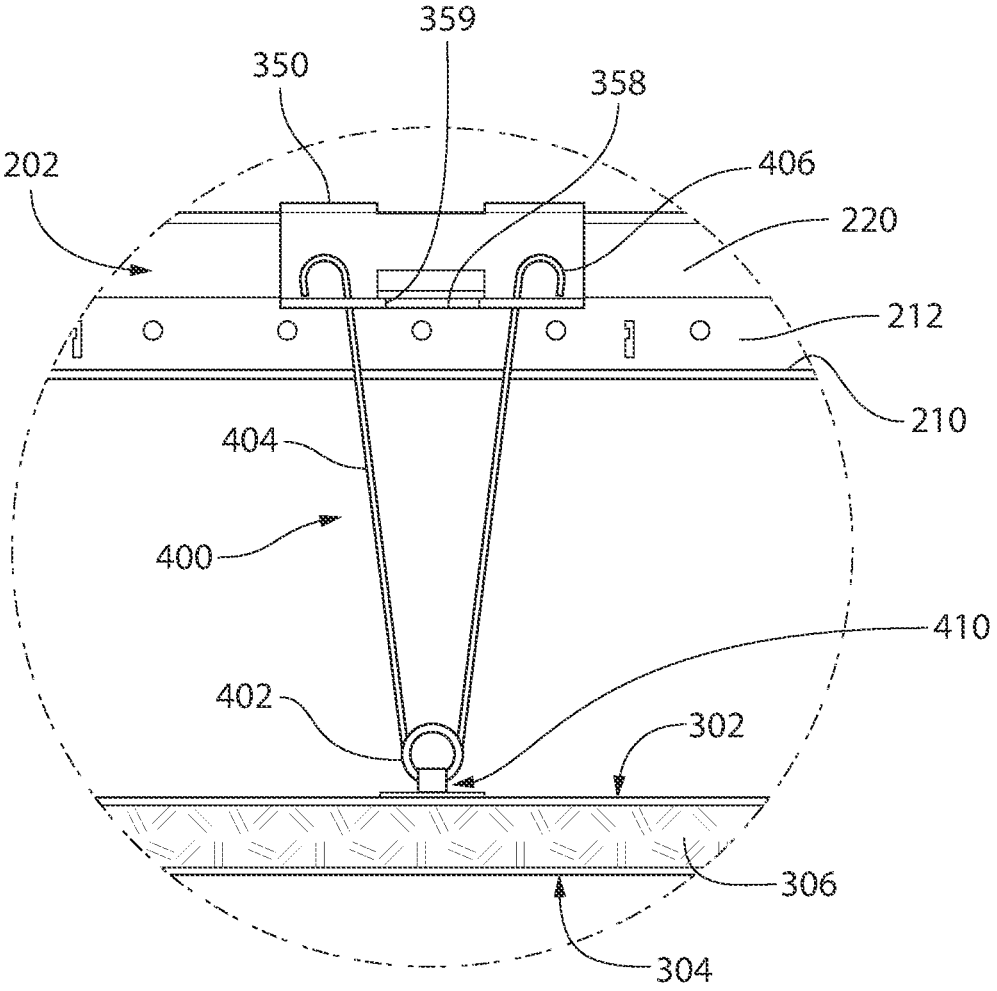
FIG. 9 is a side elevation view showing a ceiling panel with torsion spring in an open mounted position on the grid support member.

Referring now to FIG. 9, the arms 404 of the torsion spring 400 are squeezed and compressed together towards each other and inserted into slot 358 in the spring clip 350. In one embodiment, the arms 404 may be inserted laterally into the slot through lateral opening 359 while continuing to squeeze the arms 404 together. In one embodiment, the recurved ends 406 and upper portions of the spring arms 404 may be positioned initially within the slot because these ends are most flexible and easy to squeeze together. Next, the arms 404 may then be released once they are positioned within the slot 358. The upper portion of spring arms 404 engages the ends 357 of slot 358. Releasing the ceiling panel 300 engages the downward extending recurved ends 406 of arms 404 with the top surface of the flange 356 on spring clip 350 as shown. The ceiling panel 300 is now vertically spaced apart from and below the bottom of the grid support member 202 in this position by a first distance. This supports that portion of the ceiling panel 300 while the remaining springs 400 are inserted into their respective spring clips 350 on grid support members 202 in a similar manner. The position of ceiling panel 300 shown in FIG. 9 may be considered an open hung position with the ceiling panel being suspended from the grid support members 202 by the torsion springs 400.

Figure 10:
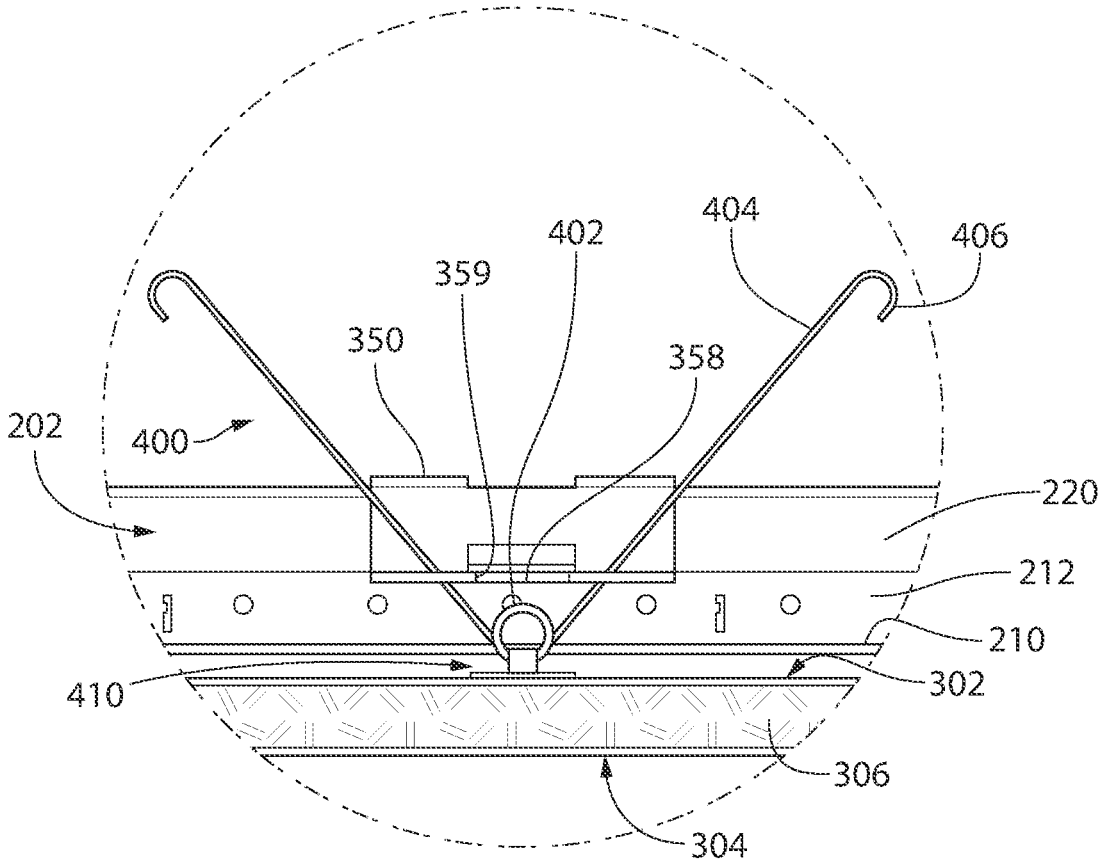
FIG. 10 is a side elevation view showing the ceiling panel with torsion spring in a closed mounted position on the grid support member.

To complete installation of the ceiling panel 300, the panel is raised vertically towards the grid support members 202. The torsion springs 400 are pushed upwards further through the slot 358, thereby allowing the spring arms 404 to spread farther apart. In one embodiment, ceiling panel is raised until top surface 302 abuts the bottom surface 206 of the grid support member 202 as shown in FIGS. 4A-B and 10. The lower portions of the spring arms 404 now engage the ends 357 of the spring clip slot 358. The outward biasing spring force k which acts to spread the spring arms 404 apart is preferably selected to retain and support the weight of ceiling panel 300 in this fully mounted position. The position of ceiling panel 300 shown in FIG. 10 may be considered a closed hung position with the ceiling panel being suspended from the grid support members 202 by the torsion springs 400.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A spring clip for mounting ceiling panels equipped with torsion springs to a ceiling support grid, the spring clip comprising:

a body including a mounting portion defining a downwardly open receptacle configured for receiving a portion of a ceiling grid support member of the ceiling support grid, the downwardly open receptacle extending along a receptacle axis from a first side open end to a second side open end;

a pair of lateral flanges extending transversely outwards from the mounting portion and terminating in lateral edges;

wherein at least one of the lateral flanges includes:

a slot extending parallel to the receptacle axis and configured to receive arms of a torsion spring; and a lateral opening extending from the lateral edge to the slot to allow lateral insertion of the arms of the torsion spring into the slot; and at least one locking tab configured to engage the ceiling grid support member to couple the spring clip to the ceiling grid support member, the at least one locking tab extending from the at least one of the lateral flanges and into the downwardly open receptacle.

2. The spring clip according to claim 1, wherein the lateral opening extends perpendicular to the receptacle axis.

3. The spring clip according to claim 1, wherein the slot includes opposing ends defined by walls that are configured to engage and retain the arms of the torsion spring.

4. The spring clip according to claim 1, wherein the mounting portion of the body comprises a top wall, a first sidewall extending downwardly from the top wall to a first terminal end, and a second sidewall extending downwardly from the top wall to a second terminal end in spaced relation to the first sidewall, wherein a first lateral flange of the pair of lateral flanges extends transversely outwardly from the first terminal end of the first sidewall and a second lateral flange of the pair of lateral flanges extends transversely outwardly from the second terminal end of the second sidewall.

5. The spring clip according to claim 1, wherein a bottom surface of the pair of lateral flanges and a bottom surface of the locking tab collectively form a bottom-most surface of the spring clip.

6. The spring clip according to claim 1, wherein the body of the spring clip is formed of an elastically deformable resilient material.

7. The spring clip according to claim 4, further comprising a first aperture formed into the first sidewall, wherein the at least one locking tab extends through the first aperture and into the downwardly open receptacle.

8. A spring clip for mounting ceiling panels equipped with torsion springs to a ceiling support grid, the spring clip comprising:

a body including a mounting portion comprising a top wall, a first sidewall extending downwardly from the top wall, and a second sidewall extending downwardly from the top wall in spaced relation to the first sidewall to define a downwardly open receptacle configured for receiving a portion of a ceiling grid support member;

a first lateral flange extending transversely outwards from a distal end of the first sidewall and terminating in a first lateral edge and a second lateral flange extending transversely outwards from a distal end of the second sidewall and terminating in a second lateral edge, wherein at least one of the first and second lateral flanges comprises a slot configured to receive arms of a torsion spring;

an aperture formed into the first sidewall and extending from the distal end of the first sidewall towards the top wall of the mounting portion; and a locking tab extending through the aperture in the first sidewall and into the downwardly open receptacle of the mounting portion of the body.

9. The spring clip according to claim 8, wherein the locking tab extends directly from an inner edge of the first lateral flange, and wherein a bottom surface of the locking tab and a bottom surface of the first lateral flange form portions of a bottommost end of the spring clip.

10. The spring clip according to claim 8, wherein each of the first and second lateral flanges comprises the slot and the lateral opening.

11. The spring clip according to claim 8, wherein the slot extends to a lateral opening formed into a respective one of the first and second lateral edges of the at least one of the first and second lateral flanges to allow lateral insertion of the arms of the torsion spring into the slot.

12. The spring clip according to claim 8, further comprising:

a second aperture formed into the second sidewall and extending from the distal end of the second sidewall towards the top wall of the mounting portion; and a second locking tab extending through the second aperture in the second sidewall and into the downwardly open receptacle of the mounting portion of the body.

13. The spring clip according to claim 12, wherein the second locking tab extends directly from an inner edge of the second lateral flange, and wherein a bottom surface of the second locking tab and a bottom surface of the second lateral flange form portions of a bottommost end of the spring clip.

14. The spring clip of claim 8, wherein the spring clip is configured to be slidable along the ceiling grid support member when locked onto the ceiling grid support member by the locking tab.

15. A ceiling system comprising:

a longitudinally extending grid support member defining a longitudinal axis;

a ceiling panel;

a torsion spring mounted on the ceiling panel; and a spring clip slideably mounted on the grid support member and movable in opposing axial directions, the spring clip comprising:

a body including a mounting portion defining a downwardly open receptacle configured for receiving a portion of the grid support member, the downwardly open receptacle extending along the longitudinal axis from a first side open end to a second side open end; and a pair of lateral flanges extending transversely outwards from the mounting portion and terminating in lateral edges;

wherein at least one of the lateral flanges includes:

a slot extending parallel to the longitudinal axis and configured to receive arms of a torsion spring; and a lateral opening extending from the lateral edge to the slot to allow lateral insertion of the arms of the torsion spring into the slot;

at least one locking tab configured to engage the grid support member to mount the spring clip to the ceiling grid support member, the at least one locking tab extending from the at least one of the lateral flanges and into the downwardly open receptacle; and wherein the ceiling panel is configured to be supported from the grid support member by the torsion springs.

16. The ceiling system according to claim 15, further comprising:

wherein the mounting portion comprises a top wall, a first sidewall extending downwardly from the top wall to a first distal end, and a second sidewall extending downwardly from the top wall to a second distal end;

an aperture formed into the first sidewall and extending form the distal end of the first sidewall towards the top wall of the mounting portion; and wherein the locking tab extends directly from the at least one of the lateral flanges and through the aperture.

17. The ceiling system according to claim 15, wherein the body of the spring clip is formed of an elastically deformable resilient material.

18. The ceiling system according to claim 15, wherein the slot extends parallel to the ceiling grid support member.

19. The ceiling system according to claim 15, wherein each of the pair of lateral flanges comprises the slot and the lateral opening.

20. The ceiling system according to claim 15, wherein the lateral opening extends perpendicular to the longitudinal axis.

* * * * *